United States Patent [19]

Yoshino et al.

[11] Patent Number: 4,843,360

[45] Date of Patent: Jun. 27, 1989

[54] POLARIZED ELECTROMAGNETIC RELAY

[75] Inventors: Kosei Yoshino, Nagano; Hirohumi Saso; Masayuki Matsumoto, both of Saku, all of Japan

[73] Assignee: Takamisawa Electric Co., Ltd., Tokyo, Japan

[21] Appl. No.: 151,664

[22] Filed: Feb. 2, 1988

[30] Foreign Application Priority Data

Feb. 5, 1987 [JP] Japan ..... 62-23519
Oct. 9, 1987 [JP] Japan ..... 62-154135[U]

[51] Int. Cl.[4] ..... H01H 51/22

[52] U.S. Cl. ..... 335/80; 335/128; 335/78

[58] Field of Search ..... 335/78–85, 335/279, 128

[56] References Cited

U.S. PATENT DOCUMENTS 3,993,971 11/1976 Ono et al. ..... 335/78
4,743,877 5/1988 Oberndorfer ..... 335/78

FOREIGN PATENT DOCUMENTS 53-122752 10/1978 Japan .

*Primary Examiner*—E. A. Goldberg
*Assistant Examiner*—Lincoln Donovan
*Attorney, Agent, or Firm*—Armstrong, Nikaido, Marmelstein, Kubovcik & Murray

[57] ABSTRACT

A relay comprises a base block having a supporting stud at the center thereof, an H-shaped armature block having a pair of armatures and a coupling member providing a hole at the center thereof, and a U-shaped core having two magnetic pole legs. The H-shaped armature block is rotatably mounted on the base block by inserting the supporting stud thereof into the hole of the armature block. The U-shaped core is mounted on the base block by fixing the legs thereto so that the magnetic pole faces of the legs oppose the armatures.

7 Claims, 7 Drawing Sheets

POLARIZED ELECTROMAGNETIC RELAY

BACKGROUND OF THE INVENTION (1) Field of the Invention

The present invention relates to a polarized electromagnetic relay.

(2) Description of the Related Art

A prior art polarized electromagnetic relay is comprised of an electromagnet unit and a contact spring mechanism having a base block. The electromagnet unit is comprised of a core, a pair of armatures combined by synthetic resin, a pair of electromagnets incorporated into the armatures, and cards fixed to the ends of the armatures for driving the contact spring mechanism. The electromagnet unit is further comprised of a separator between the core and the armatures, so that the armatures are rotatable with respect to the core, i.e. The base block (see: Unexamined Japanese Patent Publication No. 53-122752), which will be later explained in detail.

In the above-mentioned prior art relay, since the armatures are located above the core, the thickness of the electromagnet unit cannot be reduced. Note, both the core and the armatures are relatively thick. Also, due to the presence of the separator between the core and the armatures, effective use can not be made of the space within the electromagnet unit, and further, a large number of components is required for the electromagnet unit. Thus, the prior art electromagnet unit, i.e., the prior art relay, has a large scale and a high cost.

SUMMARY OF THE INVENTION

An object of the present invention is to provide a polarized electromagnetic relay having a small scale and low cost.

According to the present invention, a supporting stud is provided at the center of a base block, and a hole is provided at the center of an H-shaped armature block having a pair of armatures and a coupling member between the armatures, which member is made of at least one permanent magnet. The H-shaped armature block is rotatably mounted on the base block by inserting the supporting stud thereof into the hole of the armature block. The core has an approximately U-shape having two magnetic pole legs on both sides thereof. The U-shaped core is mounted on the base block by fixing the legs thereto between the armatures, so that the magnetic pole faces of the legs oppose the armatures.

Accordingly, in the present invention, the core and the armatures are superimposed, and thus the thickness of the relay is reduced. Also, the separator becomes unnecessary and the permanent magnet is incorporated in the armature block, and thus the number of components is reduced. This contributes to a reduction in both scale and cost.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

First, a prior art polarized electromagnetic relay will be explained with reference to FIG. 1 (See: Unexamined Japanese Patent Publication No. 53-122752).

Figure 1:
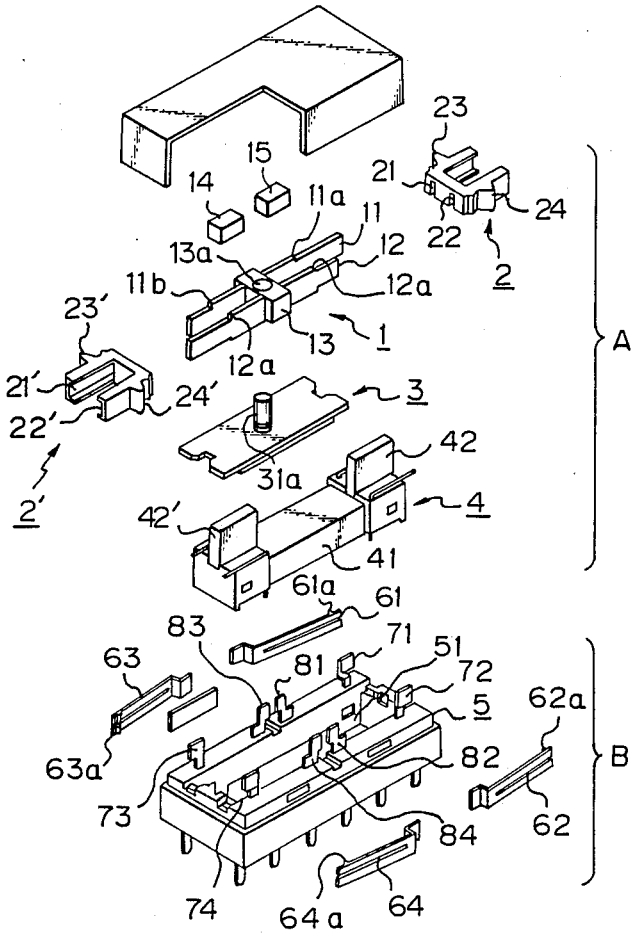
Fig. 1 PRIOR ART
FIG. 1 is an exploded, perspective view illustrating a prior art electromagnetic relay.

In FIG. 1, reference A designates an electromagnet unit, and B designates a contact spring mechanism. The electromagnet unit A is comprised of an armature block 1, cards 2 and 2', a separator 3, and a core 4.

The armature block 1 is comprised of two armatures 11 and 12 mounted in parallel and coupled by a coupling member 13 made of synthetic resin. Permanent magnets 14 and 15 are provided between the two armatures 11 and 12, i.e., the armature block 1 is constructed by insert molding. Also, provided at the center of the coupling member 13 is a hole **13*a***.

The cards 2 and 2' are of an approximately U-shape and are molded from a synthetic resin. Provided inside of the cards 2 and 2' are grooves 21, 22, 21', and 22' into which the slim sides of the armatures 11 and 12 are press-fitted. In this case, the step portions **11*a*, 12*a*, 11*b*, and 12*b* of the armatures 11 and 12 abut the faces of the cards 2 and 2', and thus the cards 2 and 2' are accurately positioned at the armatures 11 and 12**.

Also, a stud **31*a* protrudes from the center of the separator 3, and thus the armature block 1 is rotatably mounted on the separator 3 by inserting the stud 31*a* thereof into the hole 13*a* of the armature block 1**.

The core 4 is wound by a winding 41, and has two magnetic pole legs 42 and 42'. The separator 3 is mounted between the two magnetic pole legs 42 and 42', and as a result, the faces of the magnetic pole legs 42 and 42' oppose the armatures 11 and 12.

The contact spring mechanism B is comprised of a base block 5 providing a recess portion 51, four movable contact springs 61, 62, 63, and 64 having movable contacts **61*a*, 62*a*, 63*a*, and 64*a*, respectively, and four stationary contacts 71, 72, 73, and 74 which oppose the movable contacts 61*a*, 62*a*, 63*a*, and 64*a*, respectively. Also, the ends of the movable contact springs 61, 62, 63, and 64 are fixed to terminal bases 81, 82, 83, 84**, respectively.

The core 4 is mounted on the recess portion 51 of the base block 5.

In the relay of FIG. 1, when the winding 41 is excited or non-excited, the armature block 1 associated with the cards 2 and 2' is rotated with respect to the stud **31*a* of the separator 3, and therefore, a side protrusion 23 or 24 of the card 2 and a side protrusion 23' or 24' of the card 2' push against the movable contact spring 61 or 62 and the movable contact spring 63 or 64**, and thus switching, i.e., opening and closing, of the contacts is carried out.

As explained above, in the relay of FIG. 1, since the armature block 1 is located above the core 4, the thickness of the relay cannot be reduced. Also, due to the presence of the separator 3, effective use can not be made of the space within the relay, and further, a large number of components is required.

Figure 2:
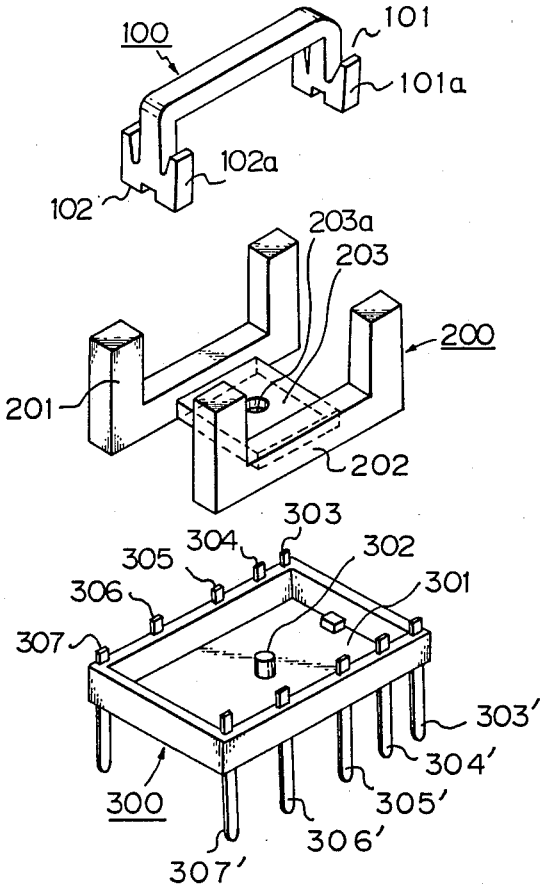
FIG. 2 is an exploded, perspective view schematically illustrating a first embodiment of the polarized electromagnetic relay according to the present invention.

In FIG. 2, which illustrates a first embodiment of the present invention, reference numeral 100 designates an approximately U-shaped core having two magnetic pole legs 101 and 102 on both sides thereof. The winding (not shown) is wound on the body of the core 100. Reference numeral 200 designates an H-shaped armature block having a pair of armatures 201 and 202 mounted in parallel and a coupling member 203 which couples the armatures 201 and 202 with each other. The coupling member 203 is formed by a permanent magnet. Also, provided at the center of the coupling member 203 is a hole 203*a*. Reference numeral 300 designates a base block made of synthetic resin. Also, a supporting stud 302 protrudes from a center of a recess portion 301 of the base block 300. The base block 300 is provided with winding terminals 303 and 303', stationary spring terminals 304 and 304', movable spring terminals 305 and 305', stationary spring terminals 306 and 306', and redundancy terminals 307 and 307'.

The H-shaped armature block 200 is rotatably mounted on the base block 300 by inserting the supporting stud 302 thereof into the hole 203*a* of the coupling member 203 of the H-shaped armature block 200. Also, the U-shaped core 100 is mounted on the base block 300 by fixing the lower sides of the magnetic pole legs 101 and 102 to the base block 300. In this case, the magnetic pole legs 101 and 102 are interposed between the two armatures 201 and 202, so that the faces 101*a* and 102*a* oppose the armatures 201 and 202.

Figure 3A:
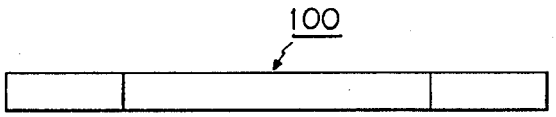
FIG. 3A is a plan view of the core of FIG. 2 where a bending operation is not carried out.
Figure 3B:
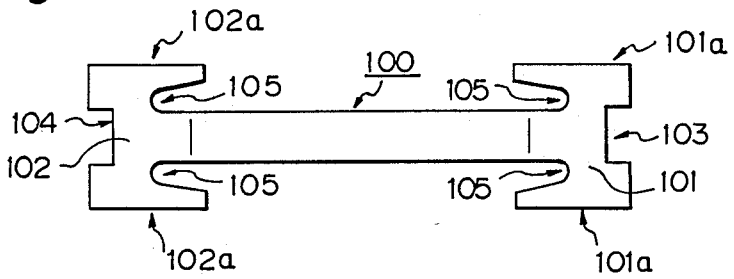
FIG. 3B is a front view of the core of FIG. 3A.
Figure 3C:
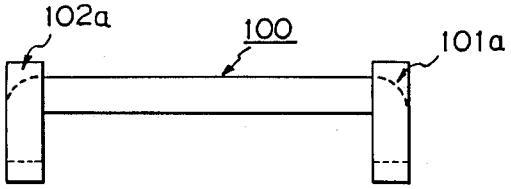
FIG. 3C is a front view of the core of FIG. 2 where a bending operation is carried out.

The manufacture of the core 100 of FIG. 2 will be explained with reference to FIGS. 3A, 3B, and 3C. The core 100 is manufactured by using a press operation considered suitable for mass production, and accordingly, contributes to a lowering of the manufacturing cost. As illustrated in FIGS. 3A and 3B, which are a plan view and a front view, respectively, an iron plate is stamped by a press operation. Reference numerals 103 and 104 designate positioning holes when the core 100 is fixed to the base block 300, and reference numerals 105 designate a portion to which a lead piece of the winding terminal 303 is fixed. The magnetic pole legs 101 and 102 are bent to thereby obtain the core 100 as illustrated in FIG. 3C.

The magnetic circuit of the relay according to the present invention will be explained with reference to FIGS. 4A, 4B, and 4C, which show an assembled state of the U-shaped core 100 and the H-shaped armature block 200.

Figure 4A:
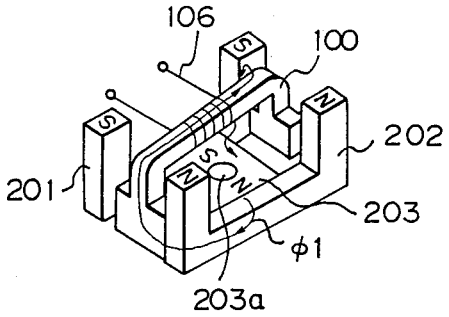
FIGS. 4A, 4B, and 4C are perspective views explaining the operation of the relay of FIG. 2.

In FIG. 4A, a winding 106 wound on the core 100 is not excited, and in this case, a magnetic circuit is formed by only the permanent magnet 203. That is, a magnetic flux $\phi 1$ generated from the permanent magnet 203 flows through a path: the N-pole of the permanent magnet 203→the armature 201→the core 100→the armature 202→S-pole of the permanent magnet 203. As a result, one end of each of the armatures 201 and 202 is in contact with the magnetic pole face 101*a* or 102*a*.

Figure 4B:
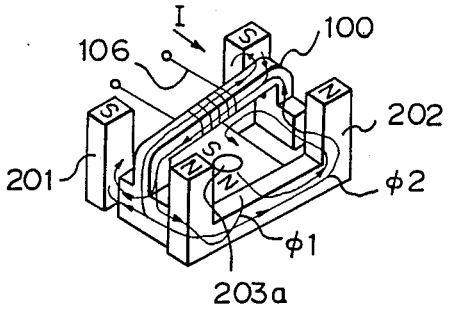

In FIG. 4B, when the winding 106 is excited by supplying a current I thereto, to generate a magnetic flux $\phi 2$ opposite to the magnetic flux $\phi 1$ by the permanent magnet 203 in the core 100, the magnetic flux $\phi 2$ flows through a path: the core 100→the armature 201→the core 100, and through a path: the core 100→the armature 202→the core 100. In this case, the magnetic flux $\phi 2$ from the armature 202 to the core 100 is opposed by the magnetic flux $\phi 1$ generated from the permanent magnet 203, to generate a repulsion force between the core 100 and the armature 202. On the other hand, the magnetic flux $\phi 2$ from the armature 201 to the core 100 is superimposed on the magnetic flux $\phi 1$ generated from the permanent magnet 203 to generate an attraction between the core 100 and the armature 201. Thus, a repulsion force is generated in a diagonal direction with respect to the hole 203*a* and an attraction force is generated in another diagonal direction with respect to the hole 203*a*. Therefore, the entire armature block 200 is rotated, and as a result, a state as illustrated in FIG. 4C prevails.

Figure 4C:
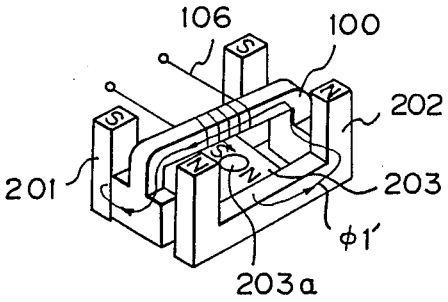

In FIG. 4C, the winding 106 is again non-excited by shutting off the current I supplied thereto. In this case, a magnetic flux $\phi 1'$ is generated from the permanent magnet 203.

Figure 5A:
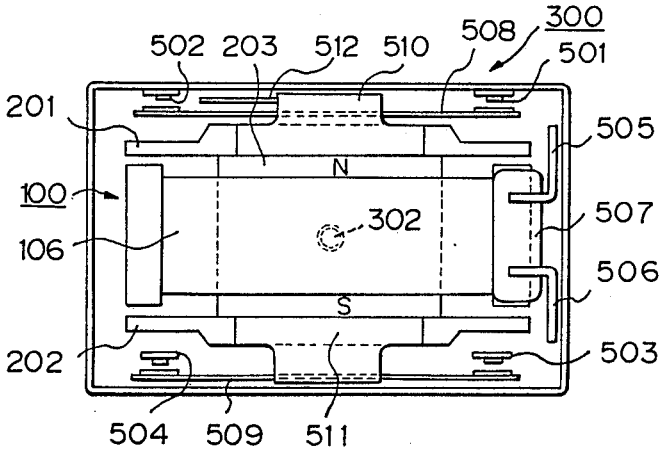
FIG. 5A is a plan view illustrating a completely assembled state of the relay of FIG. 2.
Figure 5B:
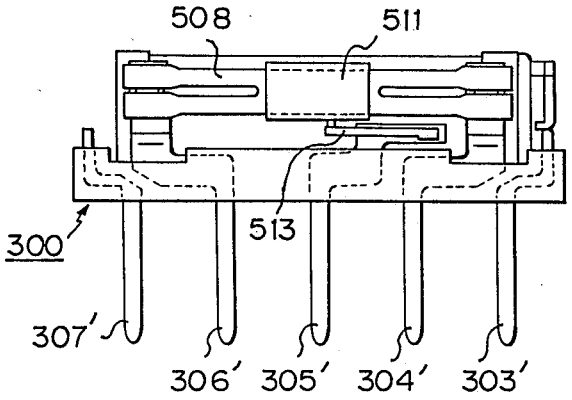
FIG. 5B is a front view of the relay of FIG. 5A.

The relay as illustrated in FIG. 2 is completely assembled as illustrated in FIGS. 5A and 5B. In FIGS. 5A and 5B, reference numerals 501 and 504 designate stationary contacts connected to the stationary spring terminals 304, 304', 306, and 306', respectively, and reference numerals 505 and 506 designate lead pieces which are connected to the winding terminals 303 and 303', respectively. The lead pieces 505 and 506 are fixed to a supporting member 507 made of synthetic resin by insert molding and, as a result, the lead pieces 505 and 506 are connected to the terminals of the winding 106 (see FIGS. 4A to 4C) at the positions of the core 100 as indicated by reference numerals 105 in FIG. 3B.

Also, in the contact spring mechanism of FIGS. 5A and 5B, movable contact springs 508 and 509 are mounted on the armatures 201 and 202 through supporting members 510 and 511 made of synthetic resin, and thus a switching between the stationary contacts and the movable contacts is carried out. Further, the movable contact springs 508 and 509 are coupled to the movable spring terminals 305 and 305' through conductive members 512 and 513. In this case, the length of the conductive members 512 and 513 must be increased to reduce the stiffness thereof. Note that the conductive members 512 and 513 are mounted as one body with the movable contact springs 508 and 509, respectively, and therefore, the manufacture of the conductive members 512 and 513 requires the use of a bending process.

Figure 6:
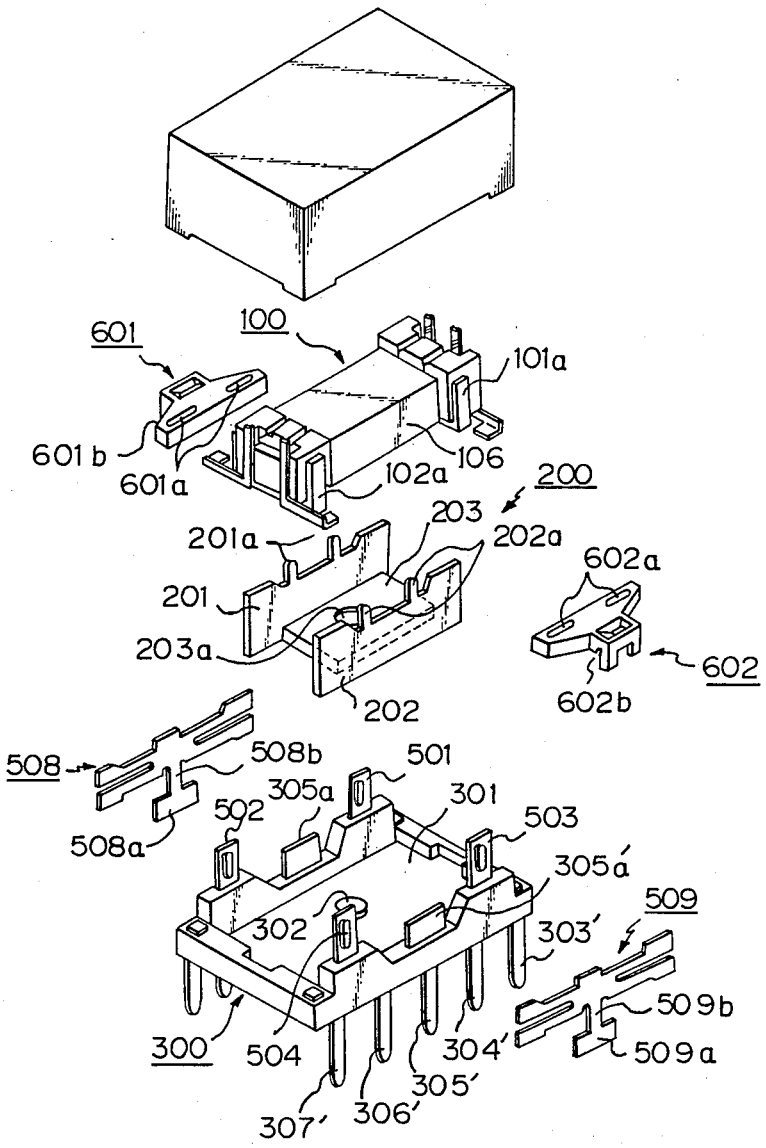
FIG. 6 is an exploded, perspective view illustrating a second embodiment of the polarized electromagnetic relay according to the present invention.

In FIG. 6, which illustrates a second embodiment of the present invention, driving cards 601 and 602 are provided instead of the supporting members 510 and 511 of FIGS. 5A and 5B, and the armatures 201 and 202, and the movable contact springs 508 and 509 are modified.

Tongue pieces 201*a* (202*a*) are formed at the armature 201 (202), is a portion 508*a* provided at the center bottom of the movable contact spring 508 (509) for welding the coupling portion 508*b* to the movable spring terminal 305 (305'). The movable contact spring 508 (509) is fixed to the upper portion 305*a* (305'*a*) of the movable spring terminal 305 (305') which is insert molded to the base block 300.

The driving card 601 (602) has penetration holes 601*a* (602*a*) into which the tonque pieces 201*a* (202*a*) are slidably inserted, and a portion 601*b* (602*b*) which is fitted to the upper center portion of the movable contact spring 508 (509). Accordingly, the armature 201 (202) is combined with the movable contact spring 508 (509) by the driving card 601 (602), using an adhesive. Note that it is possible for the driving card 601 (602) to slidably support the movable contact spring 508 (509).

Figure 7A:
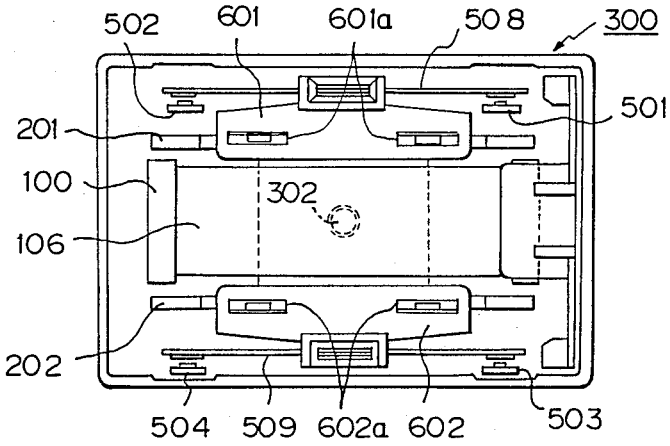
FIG. 7A is a plan view illustrating a completely assembled state of the relay of FIG. 6.
Figure 7B:
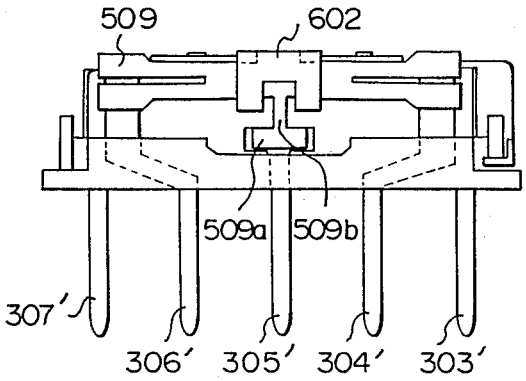
FIG. 7B is a front view of the relay of FIG. 7A.

All of the components of FIG. 6 are assembled to obtain the relay as illustrated in FIGS. 7A and 7B.

Namely, in the movable connect spring mechanism of the first embodiment, since the movable contact springs 508 and 509 are fixed via the supporting members 510 and 511 to the armatures 201 and 202, and are rotated with respect to the supporting stud 302, the amount of sliding contact between the contacts is large, thus increasing the wear of the contacts. Contrary to this, in the second embodiment, when the armatures 201 and 202 are rotated with respect to the supporting stud 302, the armatures 201 and 202 move along the penetration holes 601*a* and 602*a* of the driving cards 601 and 602 and the driving cards are rotated at the center of the movable contact springs 508 and 509. Therefore, the movable contact springs 508 and 509 are also rotated in the same way as the driving cards to open/close the contacts, and as a result, the amount of sliding contact between the contacts is very small.

As explained above, the polarized electromagnetic relay according to the present invention can be made small in size at a low cost, since the relay according to the present invention is thin and the number of components thereof is small, compared with the prior art.

We claim:

1. A relay comprising:

a base block having a supporting stud protruded from a center of a recess portion of said base block;

an H-shaped armature block including a pair of armatures mounted in parallel and a coupling member, made of at least one permanent magnet, for coupling said armatures with each other, said coupling member having a hole at the center thereof, said H-shaped armature block being rotatably mounted on said base block by inserting said stud of said base block into said hole of said H-shaped armature block; and a core having a winding wound thereon, said core having two magnetic pole legs on both sides thereof to form an approximate U-shape, said core being mounted on said base block and being located above said H-shaped armature block by fixing lower sides of said magnetic pole legs to said base block between said armatures, so that faces of said magnetic pole legs oppose said armatures.

2. A relay as set forth in claim 1, further comprising:

a pair of movable contact springs; and a pair of driving cards for coupling said movable contact springs with said armatures, respectively.

3. A relay as set forth in claim 2, wherein said driving cards are slidably coupled with said armatures, respectively.

4. A relay as set forth in claim 2, wherein said driving cards are slidably coupled with said movable contact springs, respectively.

5. A relay as set forth in claim 1, wherein said core is made by stamping an iron plate by a press process.

6. A relay as set forth in claim 1, wherein said magnetic pole legs are perpendicular to a body of said core.

7. A relay as set forth in claim 1, wherein each said armature is U-shaped.

* * * * *